US008330045B2

(12) United States Patent
Huang et al.

(10) Patent No.: US 8,330,045 B2
(45) **Date of Patent: *Dec. 11, 2012**

(54) FIRE-RESISTANT WIRE/CABLE

(75) Inventors: Yung-Hsing Huang, Taipei (TW); Chih-Ming Hu, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 546 days.

This patent is subject to a terminal disclaimer.

(21) Appl. No.: 11/642,646

(22) Filed: Dec. 21, 2006

(65) Prior Publication Data

US 2007/0149677 A1 Jun. 28, 2007

Related U.S. Application Data

(63) Continuation-in-part of application No. 11/410,913, filed on Apr. 26, 2006.

(30) Foreign Application Priority Data

Dec. 26, 2005 (TW) ..... 94146503 A

(51) Int. Cl.
*H01B 3/00* (2006.01)
*H01B 3/02* (2006.01)

(52) U.S. Cl. ..... 174/119 C; 174/110 R; 525/369; 525/123

(58) Field of Classification Search ..... 174/119 C, 174/110 R; 525/369, 123
See application file for complete search history.

(56) References Cited

U.S. PATENT DOCUMENTS

| | | | | |
|---|---|---|---|---|
| 3,714,047 | A * | 1/1973 | Marion et al. | 252/62 |
| 4,150,207 | A * | 4/1979 | Cenker et al. | 521/174 |
| 4,376,840 | A * | 3/1983 | Moriwaki et al. | 524/779 |
| 4,748,195 | A * | 5/1988 | Hackl et al. | 523/445 |
| 4,876,291 | A | 10/1989 | Dallavia, Jr. et al. | |
| 5,166,250 | A | 11/1992 | Breant | |
| 5,218,027 | A | 6/1993 | Smith et al. | |
| 5,418,272 | A * | 5/1995 | Kawabata et al. | 524/436 |
| 5,670,748 | A * | 9/1997 | Gingue et al. | 174/120 R |
| 5,723,515 | A | 3/1998 | Gottfried | |
| 5,853,809 | A * | 12/1998 | Campbell et al. | 427/407.1 |
| 5,891,571 | A | 4/1999 | Herbert et al. | |
| 6,020,419 | A | 2/2000 | Bock et al. | |
| 6,262,161 | B1 | 7/2001 | Besto et al. | |

(Continued)

FOREIGN PATENT DOCUMENTS

CA 2 210 057 C 8/1998

(Continued)

OTHER PUBLICATIONS

JP 61272222A, Dec. 1986, Derwent Abstarct.*

(Continued)

*Primary Examiner* — Satya Sastri
(74) *Attorney, Agent, or Firm* — Birch, Stewart, Kolasch & Birch, LLP

(57) ABSTRACT

The invention discloses a fire-resistant wire or cable comprising a conductor wiring and a fire-resistant organic/inorganic composite as an insulation layer or an outer sheath. The organic/inorganic composite comprises an organic component of a polymer, oligomer, or copolymer having a first reactive functional group; and inorganic particles having a second reactive functional groups. The inorganic particles are chemically bonded to the organic component via a reaction between the first and the second reactive functional groups.

5 Claims, 1 Drawing Sheet

U.S. PATENT DOCUMENTS

| | | | | |
|---|---|---|---|---|
| 6,303,681 | B1 | 10/2001 | Furukawa et al. | |
| 6,599,631 | B2 | 7/2003 | Kambe et al. | |
| 6,646,205 | B2 * | 11/2003 | Hase et al. | 174/110 R |
| 6,815,489 | B1 | 11/2004 | Fischer et al. | |
| 6,875,479 | B2 * | 4/2005 | Jung et al. | 427/493 |
| 6,893,687 | B2 * | 5/2005 | Maurus | 427/508 |
| 7,053,145 | B1 | 5/2006 | Tasaka et al. | |
| 2004/0054035 | A1 | 3/2004 | Hallissy et al. | |
| 2005/0205290 | A1 | 9/2005 | Pinacci et al. | |
| 2006/0014880 | A1 * | 1/2006 | Zhong et al. | 524/451 |
| 2006/0036006 | A1 | 2/2006 | Heschke et al. | |
| 2006/0148939 | A1 | 7/2006 | Pinto | |
| 2007/0149675 | A1 * | 6/2007 | Huang et al. | 524/425 |
| 2007/0149676 | A1 * | 6/2007 | Hu et al. | 524/425 |
| 2007/0149677 | A1 | 6/2007 | Huang et al. | |
| 2007/0179235 | A1 * | 8/2007 | Huang et al. | 524/425 |

FOREIGN PATENT DOCUMENTS

| | | | | |
|---|---|---|---|---|
| CN | 1262698 | A | | 8/2000 |
| CN | 1341141 | A | | 3/2002 |
| DE | 2854898 | A1 | | 12/1978 |
| DE | 2854898 | A | * | 6/1980 |
| DE | 237758 | A3 | | 7/1986 |
| DE | 19941181 | A1 | | 5/2000 |
| EP | 0 029 234 | A1 | | 5/1981 |
| EP | 0 330 569 | A1 | | 8/1989 |
| EP | 0 769 789 | A2 | | 4/1997 |
| EP | 1 100 093 | A3 | | 5/2001 |
| EP | 1 215 238 | A1 | | 6/2002 |
| EP | 1 215 685 | A1 | | 6/2002 |
| EP | 1384752 | A1 | | 1/2004 |
| EP | 1457523 | A1 | | 9/2004 |
| JP | 47-44351 | | | 11/1972 |
| JP | 51022799 | A | * | 2/1976 |
| JP | 57-92037 | A | | 6/1982 |
| JP | 59-42779 | A | | 3/1984 |
| JP | 61272222 | A | * | 12/1986 |
| JP | 62-201934 | A | | 9/1987 |
| JP | 64-41112 | A | | 2/1989 |
| JP | 02202907 | A | * | 8/1990 |
| JP | 02210717 | A | * | 8/1990 |
| JP | 4-55454 | A | | 2/1992 |
| JP | 5-239281 | A | | 9/1993 |
| JP | 7-211153 | A | | 8/1995 |
| JP | 08113682 | A | | 5/1996 |
| JP | 9-59509 | A | | 3/1997 |
| JP | 9-204824 | A | | 8/1997 |
| JP | 10029278 | A | | 2/1998 |
| JP | 10-120946 | A | | 5/1998 |
| JP | 10147707 | A | * | 6/1998 |
| JP | 10-245456 | A | | 9/1998 |
| JP | 11080538 | A | * | 3/1999 |
| JP | 11-306873 | A | | 11/1999 |
| JP | 11-310720 | A | | 11/1999 |
| JP | 2000-191845 | A | | 7/2000 |
| JP | 2001-2840 | A | | 1/2001 |
| JP | 2002-179857 | A | | 6/2002 |
| JP | 2002-324442 | A | | 11/2002 |
| JP | 2003-96306 | A | | 4/2003 |
| JP | 2004254407 | A | * | 9/2004 |
| JP | 2005-60675 | A | | 3/2005 |
| JP | 2005-162931 | A | | 6/2005 |
| JP | 2005-213480 | A | | 8/2005 |
| JP | 2005-232264 | A | | 9/2005 |
| JP | 2005-322474 | A | | 11/2005 |
| TW | 442549 | | | 9/1987 |
| TW | 397885 | | | 7/1988 |
| TW | 499469 | | | 2/1989 |
| TW | 583078 | | | 6/1990 |
| TW | 419514 | | | 1/2001 |
| TW | 200415235 | A | | 8/2004 |
| TW | 263628 | B1 | | 10/2006 |
| WO | WO 99/27015 | A1 | | 6/1999 |
| WO | 2004/035711 | A1 | | 4/2004 |

OTHER PUBLICATIONS

JP11-080538A, Mar. 1998, Kumasaka, Machine translation.*
JP 2004254407 A, Sep. 2004, English Translation.*
JP 02202907 A, Aug. 1990, English Translation.*
JP 10147707 A, Jun. 1998, Machine translation.*
DE 2854898 A, Jun. 1980, English Translation.*
JP 51022799 A, Feb. 1976, English Translation.*
JP 02210717A, Aug. 1990, English Ab.*
JP 2004254407 A, Sep. 2004, English Abstract.*
Office Action dated Jan. 27, 2011 for Taiwanese Application No. 095148155.
CN Office Action, Appl. No. 200610171789.2, Feb. 10, 2011, pp. 1-5.
CN Office Action, Appl. No. 200610171790.5, Mar. 3, 2011, pp. 1-3.
Finnish Office Action dated Jan. 3, 2011 for Finnish Application No. 20070484.
Japanese Office Action dated Apr. 12, 2011 for Japanese Application No. 2006-348596.
Taiwanese Notice of Allowance dated Apr. 27, 2011 for Taiwanese Application No. 095148155.
Japanese Office Action, Appl. No. 2006-348595, Aug. 30, 2011, pp. 1-2 (w/ English translation).
Chinese Office Action, Appl. No. 200610171789.2, Oct. 29, 2010, pp. 1-4.
German Examination Report, Appl. No. 102006062148.4-43; Sep. 28, 2010, pp. 1-4 (w/ full English translation).
German Office Action issued Nov. 4, 2010, in German Application No. 10 2006 062 147.6-34.
German Office Action issued Sep. 28, 2010, in German Application No. 10 2006 062 146.8-43.
Japanese Office Action issued Nov. 30, 2010, in Japanese Application No. 348595/2006, with partial translation.

* cited by examiner

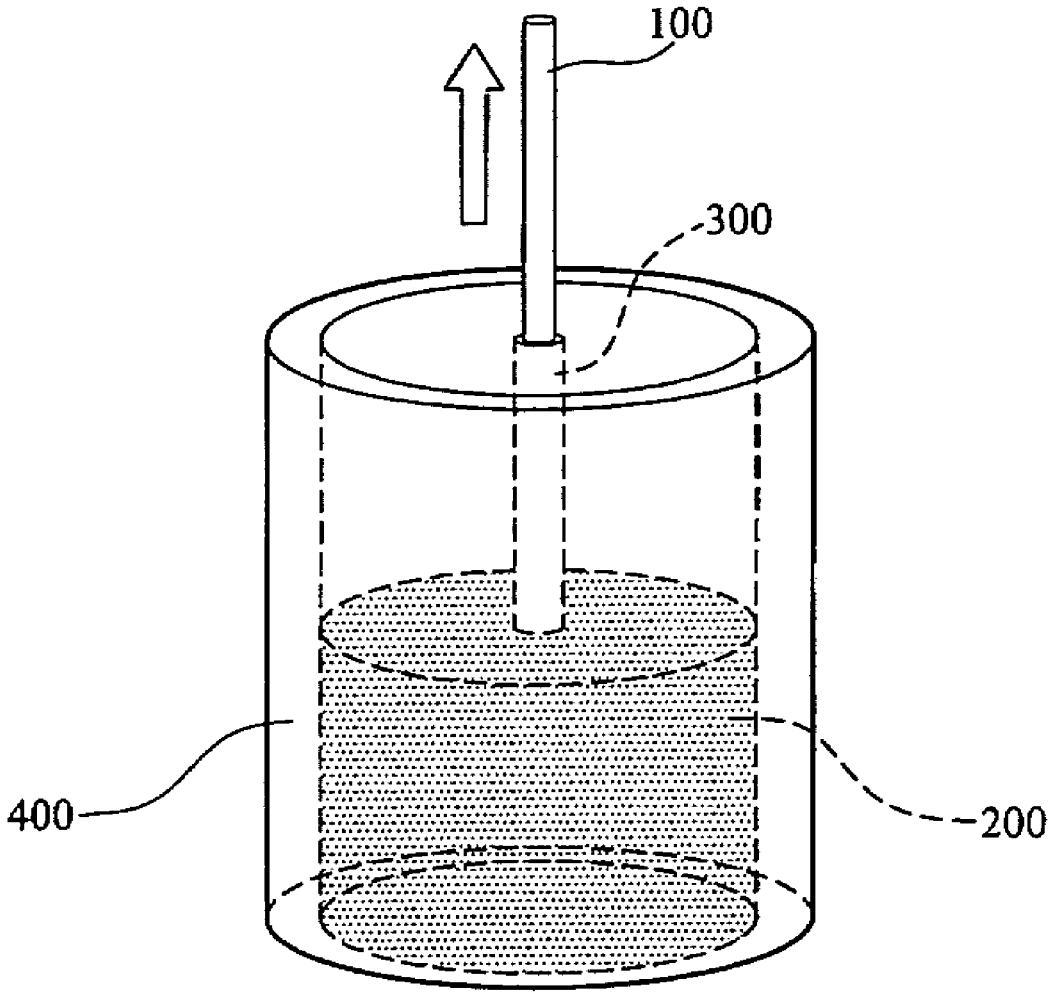
100
300
400
200

FIRE-RESISTANT WIRE/CABLE

CROSS-REFERENCE TO RELATED APPLICATIONS

This application is a Continuation-In-Part of application Ser. No. 11/410,913, filed on Apr. 26, 2006, which claims priority to Taiwan Patent Application no. 94146503, filed on Dec. 26, 2005.

BACKGROUND OF THE INVENTION

1. Field of the Invention

The invention relates to a wire or cable, and more particularly to a fire-resistant wire or cable having an fire-resistant insulation layer or a fire-resistant outer sheath.

2. Description of the Related Art

Fire resistant or fire retardant materials can be used as architectural or decorative materials. Architectural materials disclosed in Taiwan Patent Nos. 583,078 and 397,885 primarily comprise a stacked layer, serving as a fire resistant layer, comprising nonflammable inorganic materials such as pearlite (or perlite), $MgCl_2$, MgO, $CaCO_3$ or cement. In addition, a stiff fire resistant laminate can be obtained from flexible substrates made of fibers or non-wovens blended with flame retardants, foaming agents and 50~80 inorganic materials by weight.

Fire resistant coatings, serving as decorative materials, disclosed in Taiwan Patent Nos. 442,549, 499,469 and 419,514 comprise a combination of foaming and intumescent agents, carbonization agents, flame retardants, and adhesives which foam and intumesce when exposed to fire. U.S. Pat. No. 5,723,515 discloses a fire-retardant coating material including a fluid intumescent base material having a foaming agent, a blowing agent, a charring agent, a binding agent, a solvent, and a pigment, for increasing resistance to cracking and shrinking. A compound disclosed by U.S. Pat. No. 5,218,027 is manufactured from a composition of a copolymer or terpolymer, a low modulus polymer, and a synthetic hydrocarbon elastomer. The fire retardant additive comprising a group I, group II or group III metal hydroxide with the proviso that at least 1% by weight of the composition is in the form of an organopolysiloxane. U.S. Pat. No. 6,262,161 relates to filled interpolymer compositions of ethylene and/or alpha-olefin/vinyl or vinylidene monomers, showing improved performance when exposed to fire or ignition sources, and fabricated articles thereof. The articles are often in the form of a film, sheet, a multilayered structure, a floor, wall, or ceiling covering, foams, fibers, electrical devices, or wire and cable assemblies.

EP Patent No. 10330569, JP Patent No. 7211153, KR Patent No. 9201723B and EP Patent No. 0029234 disclose an outer sheath of wire or cable comprising polyvinyl chloride (PVC). Further, EP Patent No. 0769789 and U.S. Pat. No. 5,891,571 disclose mixing the polyvinyl chloride with calcium salt, zinc salt, magnesium salt, aluminum salt, phosphate, hologenated plasticize, aluminum hydroxide, zinc stannate to increase the flame retardant property. Moreover, JP Patent No. 1041112 discloses an outer sheath comprising the copolymer ethylene-PVC with ethylene vinyl acetate-PVC.

Due to the inferior electrical insulation characteristics of PVC, a novel insulation layer or an outer sheath of fire-resistant wire or cable is called for. U.S. Pat. No. 6,303,681 (B1), U.S. Pat. No. 5,166,250, JP Patent No. 2000191845, US Patent No. 20060148939, and CA Patent No. 2210057 disclose mixing the polypropylene (or polyethylene) with metal oxide. JP Patent No. 2005322474 disclose mixing the copolymer of EVA with styrene-ethylene-butylene and $Mg(OH)_2$ to fabricate the insulation layer or an outer sheath of metal wire. US Patent No. 20050205290 discloses mixing the HDPE and borax glass to improve the flame retardant property of the fire-resistant wire. Conventional flame retardant polymer compositions are obtained by physical bending of organic polymer and inorganic flame retardant, wherein coupling agents or surfactants are typically incorporated to improve the dispersity of inorganic flame retardant. However, because the organic polymer does not react with inorganic component to form a well-structured composite by the formation of chemical bonds, the conventional flame retardant compositions easily melt, ignite, or produce flaming drops under exposure to flame or ignition sources.

BRIEF SUMMARY OF THE INVENTION

Fire-resistant wires or cables are provided. An exemplary embodiment of a fire-resistant wire or cable comprises a conductor wiring and an organic/inorganic composite as an insulation layer or an outer sheath layer. Particularly, the organic/inorganic composite comprises an organic component and inorganic particles, wherein the organic component has a first reactive functional group, the organic component comprising polymer, copolymer, or oligomer, and the inorganic particle has a second reactive functional group. The inorganic particles are chemically bonded to the organic component via a reaction between the first and second reactive functional groups. Moreover, the organic/inorganic composite is coated on the conductor wiring by dipping or extrusion.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 1 is a schematic FIGURE showing the fabrication method of the fire-resistant outer sheath of Example 1.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

In the invention, inorganic particles having reactive functional groups, originally or after surface modification, are well dispersed in and reacted with an organic component such as polymer, monomer, oligomer, prepolymer, or copolymer to enhance the fire retardant and mechanical properties. The organic/inorganic composite can be with admixed with a suitable continuous phase, depending on the type of organic component, to provide a fire-resistant coating material.

The organic/inorganic composite typically comprises 10-90% by weight of the organic component, and 90-10% by weight of the inorganic particles. Preferably, the organic/inorganic composite comprises 30-70% by weight of the organic component, and 70-30% by weight of the inorganic particles, and more preferably comprises 40-60% by weight of the organic component, and 6040% by weight of the inorganic particles.

Because the organic component and the inorganic particles can be directly reacted by mixing for forming covalent or ionic bonds, the organic component of the organic/inorganic composite is not melted and ignited, preventing ignition and spreading of flame. After burning, the organic component of the organic/inorganic composite is converted into a carbonaceous layer, and the inorganic particles dissipate heat by radiation heat transfer. Further, because the organic/inorganic composite does not comprise the halide compound, no toxic gas comprising halogens is released when burning the organic/inorganic composite.

The fire-resistant coating material of the invention is in slurry form. The organic component in the coating material can be polymer, monomer, oligomer, prepolymer, or copolymer, while the organic component in a solidified coating can be oligomer, polymer, or copolymer. For the purposes of the invention, the term "polymer" refers to compounds having a number average molecular weight in the range of 1500 to over 1,00,000 Daltons, while "oligomer" refers to compounds having number average molecular weights in the range of 200 to 1499 Daltons.

In the organic/inorganic composite, the organic component and the inorganic particles are chemically bonded via reactions of corresponding reactive functional groups. The reactive functional groups of the organic component and inorganic particles include, but are not limited to, —OH, —COOH, —NCO, —$NH_3$, —$NH_2$, —NH, and epoxy groups. For example, an organic component having —COOH or —NCO groups (e.g., organic acid or reactive polyurethane) can be employed to react with inorganic particles having —OH groups (e.g., metal hydroxide). In addition, an organic component having epoxy groups can be employed to react with inorganic particles having —$NH_2$ groups. Alternatively, an organic component having —OH groups (e.g., polyvinyl alcohol) may react with inorganic particles having —COOH or —NCO groups, and an organic component having —$NH_2$ groups may react with inorganic particles having epoxy groups.

The organic component suitable for use can include any monomer, oligomer, monopolymer, copolymer, or prepolymer that contains the above-mentioned reactive functional groups. The reactive functional groups may reside in the backbone or a side chain of the polymer. Preferred organic components include polyoragnic acid, polyurethane, epoxy, polyolefin, and polyamine. The polyorganic acid includes momopolymers or copolymers that contain carboxylic or sulfonic acids such as poly(ethylene-co-acrylic acid and poly (acrylic acid-co-maleic acid). Illustrative examples of epoxy include bis(3,4-epoxy-6-methylcyclohexylmethyl) adipate, vinylcyclohexene dioxide, diglycidyl tetrahydrophthalate, diglycidyl hexahydrophthalate, bis(2,3-epoxycyclopentyl) ether resin, glycidyl ethers of polyphenol epoxy resin. The polyamines suitable for use include polyamine and polyimide. Illustrative examples of polyamine include nylon 6 ($(NH(CH_2)_5CO)_n$), nylon 66 ($(NH(CH_2)_6—NH—CO(CH_2)_4CO)_n$), and nylon 12 ($(NH(CH_2)_{11}CO)_n$). The polyimide includes diamine such as 4,4-oxydianiline, 1,4-bis(4-aminophenoxy)benzene, or 2,2-bis[4-(4-aminophenoxy)phenyl] propane; and also includes polyimide synthesized by the diamine and dianhydride such as oxydiphthalic anhydride, pyromellitic dianhydride, or benzophenone tetracarboxylic dianhydride. The polyolefin suitable for use includes copolymers of an olefin monomer and a monomer having the above reactive functional groups. It should be noted that the organic component also includes monomer, oligomer, copolymer and prepolymer of the above illustrative polymers. In addition, these organic components may be used alone or in an admixture of two or more.

The inorganic particles suitable for use are those having corresponding functional groups, originally or after surface modification, that can react with the functional groups of the organic component. The preferred inorganic particles include hydroxide, nitride, oxide, carbide, metal salt, and inorganic layered material. The hydroxide includes metal hydroxide such as $Al(OH)_3$ or $Mg(OH)_2$. The nitride includes, for example, BN and $Si_3N_4$. The carbide includes, for example, SiC. The metal salt includes, for example, $CaCO_3$. The inorganic layered material includes, for example, clay, talc, and layered double hydroxide (LDH), wherein the clay can be smectite clay, vermiculite, halloysite, sericite, saponite, montmorillonite, beidellite, nontronite, mica, or hectorite. The inorganic particles also can be used in an admixture of two or more. For example, a clay having reactive functional groups can be used in combination with metal hydroxide. Suitable inorganic particles include micro-sized particles and nano-sized particles. Nano-sized particles having diameters between 1 and 100 nm are particularly preferred because the smaller particle size the greater the surface area per unit weight.

The organic component and the inorganic particles can be directly mixed for reaction to form covalent bonds, or the reaction can be carried out in various solvates (e.g., water, ethanol, or methyl ethyl ketone). The reaction temperature is generally from room temperature to about 150° C. and the reaction time may vary from 10 minutes to a few days, depending on utilized starting materials.

The fire-resistant coating material of the invention has a wide range of applications. For example, it is suitable as fire-resistant material for coating indoor structures or structural steel. It can further be used as coating material for cable wraps, wire wraps, or foaming materials. The fire-resistant coating material can also be used on flammable objects in vehicles such as airplanes, ships, cars, and trains. Accordingly, those of ordinary skill in the art may incorporate various additives depending on the specific application. For example, flame retardant such as melamine phosphates, red phosphorus, and phosphorus-based flame retardant may be present to improve the flame retardant property. Silane (such as TEOS or TEVS) or siloxane may be present to strengthen structural integrity and facilitate curing. Glass sand and glass fiber may be present to improve the heat resistance and strengthen structural integrity. The amount of these additives is typically between 0.1 and 20 parts by weight, based on 100 parts by weight of the organic/inorganic composite.

In an embodiment of the invention, the organic/inorganic composite is coated on the conductor wiring by dipping or extrusion, obtaining the fire-resistant wire or cable such as power wire, data wire, or communication wire. Because the organic component and the inorganic particles are chemically bonded (compared to the conventional physical bending products), the fire-resistant composite of the invention does not melt, ignite or produce flaming drops under exposure to flame or ignition sources. The flame retardant property of the fire-resistant wire or cable is sufficient flame retardant property to pass the UL 1581 Vertical Wire Flame Test VW-1.

In some embodiments of invention, the fire-resistant wire or cable can comprise the organic/inorganic composite as an insulation layer covering the conductor wiring, and an outer sheath such as PVC or nylon covering the organic/inorganic composite. In some embodiments of invention, the fire-resistant wire or cable can comprise an insulation layer such as PE or PP covering the conductor wiring, and the organic/inorganic composite as an outer sheath covering the insulation layer. Specifically, the insulation layer and outer sheath layer can be formed in batches, and formed simultaneously by co-extrusion.

EXAMPLE 1

300 g of polyethylene-co-acrylic acid (15 wt % acrylic acid) was charged in a reactor, preheated to melt at 110-120° C. and then stirred at 300 rpm. 324.0 g of deionized water and 324.0 g of aqueous ammonia were added to the reactor, giving a white emulsion after stirring for 10 minutes. 300 g of aluminum hydroxide powder were subsequently added to the reactor, giving white slurry after stirring for 10 minutes. As shown in FIG. 1, 0.25 mm-thick, 0.53 mm-thick, and 1.02 mm-thick slurries 200 within the container 400 were respectively coated on copper wires 100 (grade: 14AWG/3G) to form an outer sheath layer 300 and then placed in an oven, dried at 60° C. for 60 minutes, 80° C. for 60 minutes, 100° C. for 60 minutes, 120° C. for 30 minutes, 140° C. for 30 minutes, and finally, molded at 160° C. for 240 minutes.

After completely hardening, the obtained fire-resistant wire was subjected to a UL 1581 Vertical Wire Flame Test VW-1, the results of which are shown in Table. 1. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the —COOH functional group of poly ethylene-co-acrylic acid with the —OH functional group of aluminum hydroxide powder, the fire-resistant wire or cable with the organic/inorganic composite as an insulation layer or an outer sheath showed enhanced flame retardant property.

TABLE 1

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.25 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 0.53 ± 0.05 mm | 1 | None | None | None | None | None | no | No | X | |
| | 2 | None | None | None | None | None | no | no | X | |
| | 3 | None | None | None | None | None | no | No | X | |
| 1.02 ± 0.05 mm | 1 | None | None | None | None | None | no | No | X | |
| | 2 | None | None | None | None | None | no | no | X | |
| | 3 | None | None | None | None | None | no | No | X | |

EXAMPLE 2

300 g of poly ethylene-co-acrylic acid (15 wt % acrylic acid) was charged in a reactor, preheated to melt at 110-120° C. and then stirred at 300 rpm.300 g of aluminum hydroxide powder were subsequently added to the reactor, giving white slurry after stirring for 10 minutes. The white slurry was fed into an extruder, and copper wires (grade: 14AWG/3G) with 0.2 mm-thick, 0.5 mm-thick, and 1 mm-thick outer sheath layer were fabricated by co-extrusion at 130□ and then placed in an oven, dried at 60° C. for 60 minutes, 80° C. for 60 minutes, 100° C. for 60 minutes, 120° C. for 30 minutes, 140° C. for 30 minutes, and finally, molded at 160° C. for 240 minutes.

After completely hardening, the obtained fire-resistant wire was subjected to a UL 1581 Vertical Wire Flame Test VW-1, the results of which are shown in Table. 2. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the polyethylene-co-acrylic acid with the aluminum hydroxide powder, the fire-resistant wire or cable with the organic/inorganic composite as an insulation layer or an outer sheath showed an enhanced flame retardant property.

TABLE 2

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.2 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 0.5 ± 0.05 mm | 1 | None | None | None | None | None | no | no | X | |
| | 2 | None | None | None | None | None | no | no | X | |
| | 3 | None | None | None | None | None | no | no | X | |
| 1.0 ± 0.05 mm | 1 | None | None | None | None | None | no | no | X | |
| | 2 | None | None | None | None | None | no | no | X | |
| | 3 | None | None | None | None | None | no | no | X | |

EXAMPLE 3

300 g of poly maleic acid-co-acrylic acid was charged in a reactor, preheated to melt at 110-120° C. and then stirred at 300 rpm. 300 g of magnesium hydroxide powder were added to the reactor, giving white slurry after stirring for 10 minutes. After cooling, the white slurry altered to yellow solid. The yellow solid was fed into an extruder, and copper wires (grade: 14AWG/3G) with 0.2 mm-thick, 0.5 mm-thick, and 1 mm-thick outer sheath layer were fabricated by co-extrusion at 130□ and then placed in an oven, dried at 60° C. for 60 minutes, 80° C. for 60 minutes, 100° C. for 60 minutes, 120° C. for 30 minutes, 140° C. for 30 minutes, and finally, molded at 160° C. for 240 minutes.

After completely hardening, the obtained fire-resistant wire was subjected to a UL 1581 Vertical Wire Flame Test VW-1, the results of which are shown in Table. 3. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the poly maleic acid-co-acrylic acid with the magnesium hydroxide powder, the fire-resistant wire or cable with the organic/inorganic composite as an insulation layer or an outer sheath showed an enhanced flame retardant property.

TABLE 3

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.2 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 0.5 ± 0.05 mm | 1 | None | None | None | None | None | no | no | X | |
| | 2 | None | None | None | None | None | no | no | X | |
| | 3 | None | None | None | None | None | no | no | X | |
| 1.0 ± 0.05 mm | 1 | None | None | None | None | None | no | no | X | |
| | 2 | None | None | None | None | None | no | no | X | |
| | 3 | None | None | None | None | None | no | no | X | |

EXAMPLE 4

500 g of reactive polyurethane (with 8% —NCO) was charged in a reactor and then stirred at 300 rpm. 500 g of aluminum hydroxide powder were added to the reactor, giving white slurry after stirring for 5 minutes. 1.04 mm-thick, 2.15 mm-thick, and 2.97 mm-thick slurries within the container were respectively coated on copper wires (grade: 14AWG/3G) by dipping and then placed at room temperature for 24 hr.

After completely hardening, the obtained fire-resistant wire was subjected to a UL 1581 Vertical Wire Flame Test VW-1, the results of which are shown in Table. 4. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the —NCO functional group of reactive polyurethane with the —OH functional group of aluminum hydroxide powder, the fire-resistant wire or cable with the organic/inorganic composite as an insulation layer or an outer sheath showed an enhanced flame retardant property.

TABLE 4

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 1.04 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 2.15 ± 0.05 mm | 1 | None | None | None | None | None | no | no | X | |
| | 2 | None | None | None | None | None | no | no | X | |
| | 3 | None | None | None | None | None | no | no | X | |
| 2.97 ± 0.05 mm | 1 | None | None | None | None | None | no | no | X | |
| | 2 | None | None | None | None | None | no | no | X | |
| | 3 | None | None | None | None | None | no | no | X | |

EXAMPLE 5

500 g of reactive polyurethane (with 8% —NCO) dissolved in 300 g DMAC was charged in a reactor and then stirred at 300 rpm. 500 g of aluminum hydroxide powder were added to the reactor, giving white slurry after stirring for 5 minutes. 0.21 mm-thick, 0.49 mm-thick, and 0.98 mm-thick slurries within the container were respectively coated on copper wires (grade: 14AWG/3G) by dipping. After drying for 24 hr, the copper wires with slurry placed in the oven at 105□ for 24 hr.

After completely hardening, the obtained fire-resistant wire was subjected to a UL 1581 Vertical Wire Flame Test VW-1, the results of which are shown in Table. 5. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the —NCO functional group of reactive polyurethane with the —OH functional group of aluminum hydroxide powder, the fire-resistant wire or cable with the organic/inorganic composite as an insulation layer or an outer sheath showed an enhanced flame retardant property.

TABLE 5

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.21 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 0.49 ± 0.05 mm | 1 | None | None | None | None | None | no | no | X | |
| | 2 | None | None | None | None | None | no | no | X | |
| | 3 | None | None | None | None | None | no | no | X | |
| 0.98 ± 0.05 mm | 1 | None | None | None | None | None | no | no | X | |
| | 2 | None | None | None | None | None | no | no | X | |
| | 3 | None | None | None | None | None | no | no | X | |

EXAMPLE 6

500 g of reactive polyurethane (with 8% —NCO) was charged in a reactor and then stirred at 300 rpm. 450 g of magnesium hydroxide powder and 50 g modified nano-clay with —OH functional group were added to the reactor, giving white slurry after stirring for 5 minutes. 1.10 mm-thick, 2.26 mm-thick, and 2.95 mm-thick slurries within the container were respectively coated on copper wires (grade: 14AWG/3G) by dipping and then placed at room temperature for 24 hr.

After completely hardening, the obtained fire-resistant wire was subjected to a DL) 1581 Vertical Wire Flame Test VW-1, the results of which are shown in Table. 6. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the —NCO functional group of reactive polyurethane with the —H functional group of magnesium hydroxide powder and clay, the fire-resistant wire or cable with the organic/inorganic composite as an insulation layer or an outer sheath showed an enhanced flame retardant property.

TABLE 6

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 1.10 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 2.26 ± 0.05 mm | 1 | None | None | None | None | None | no | no | X | |
| | 2 | None | None | None | None | None | no | no | X | |
| | 3 | None | None | None | None | None | no | no | X | |
| 2.95 ± 0.05 mm | 1 | None | None | None | None | None | no | no | X | |
| | 2 | None | None | None | None | None | no | no | X | |
| | 3 | None | None | None | None | None | no | no | X | |

EXAMPLE 7

500 g of reactive polyurethane (with 7.6% —NCO) was charged in a reactor and then stirred at 300 rpm. 450 g of modified titanium oxide and 50 g modified clay-clay with —OH functional group were added to the reactor, giving white slurry after stirring for 5 minutes. 0.7 mm-thick, 1.46 mm-thick, and 2.00 mm-thick slurries within the container were respectively coated on copper wires (grade: 14AWG/3G) by dipping and then placed at room temperature for 24 hr and placed in oven at 80□ for 24 hr.

After completely hardening, the obtained fire-resistant wire was subjected to a UL 1581 Vertical Wire Flame Test VW-1, the results of which are shown in Table. 7. In all tests, the outer sheath layers of the organic/inorganic composites did not ignite, and the flags (attached at the top of sample) did not ignite or burn. Further, flaming debris dropped from the sample did not ignite cotton placed on the floor around the sample, passing the UL 1581 Vertical Wire Flame Test VW-1.

Accordingly, because the organic/inorganic composite comprises the reactive product obtained by chemically bonding the —NCO functional group of reactive polyurethane with the —OH functional group of modified titanium oxide and clay, the fire-resistant wire or cable with the organic/inorganic composite as an insulation layer or an outer sheath showed an enhanced flame retardant property.

TABLE 7

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.70 ± 0.05 mm | 1 | None | None | None | None | None | no | no | X | |
| | 2 | None | None | None | None | None | no | no | X | |
| | 3 | None | None | None | None | None | no | no | X | |
| | | After each 15 second flame application Record Flaming Duration in seconds | | | | | | | | |
| 1.46 ± 0.05 mm | 1 | None | None | None | None | None | no | no | X | |
| | 2 | None | None | None | None | None | no | no | X | |
| | 3 | None | None | None | None | None | no | no | X | |
| 2.00 ± 0.05 mm | 1 | None | None | None | None | None | no | no | X | |
| | 2 | None | None | None | None | None | no | no | X | |
| | 3 | None | None | None | None | None | no | no | X | |

COMPARATIVE EXAMPLE 1

500 g of reactive polyurethane (with 7.6% —NCO) was charged in a reactor and then stirred at 300 rpm. 500 g silicon oxideheated at 80□ for 6 h was added to the reactor, giving white slurry after stirring for 5 minutes. 0.72 mm-thick, 1.31 mm-thick, and 2.01 mm-thick slurries within the container were respectively coated on copper wires (grade: 14AWG/3G) by dipping and then placed at room temperature for 24 hr, placed in oven at 80□ for 24 hr, and finally, molded at 25° C. for 72 hr.

After completely hardening, the obtained fire-resistant wire was subjected to a UL 1581 Vertical Wire Flame Test VW-1, the results of which are shown in Table. 8. In all tests, the outer sheath layers of the organic/inorganic composites were ignited, and the flags (attached at the top of sample) were ignited and burned. The test was considered to be a failure. Further, flaming debris dropped from the sample ignited the cotton placed on the floor around the sample.

Accordingly, because the —H functional group of silicon oxide was removed after heating at 80□ for 6 hr, there were not enough —OH functional groups to react with the —NCO functional group of reactive polyurethane. Therefore, in the comparative example 1, the outer sheath of the fire-resistant wire does not comprise the organic/inorganic composite as disclosed in the invention and exhibits an inferior flame retardant property.

TABLE 8

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.72 ± 0.05 mm | 1 | None | 120 (fully burned) | | | | yes | no | | X |
| | 2 | | 82 (fully burned) | | | | yes | yes | | X |
| | 3 | | 66 (fully burned) | | | | yes | no | | X |
| | | After each 15 second flame application Record Flaming Duration in seconds | | | | | | | | |
| 1.31 ± 0.05 mm | 1 | None | 94 (fully burned) | | | | yes | no | | X |
| | 2 | | 88 (fully burned) | | | | yes | yes | | X |
| | 3 | | 76 (fully burned) | | | | yes | yes | | X |
| 2.01 ± 0.05 mm | 1 | None | 88 (fully burned) | | | | yes | yes | | X |
| | 2 | None | 116 (fully burned) | | | | yes | no | | X |
| | 3 | | 97 (fully burned) | | | | yes | yes | | X |

COMPARATIVE EXAMPLE 2

500 g of polyurethane (without —NCO) was charged in a reactor and then stirred at 300 rpm. 500 g aluminum hydroxide powder was added to the reactor, giving white slurry after stirring for 5 minutes. 0.52 mm-thick, 1.17 mm-thick, and 1.88 mm-thick slurries within the container were respectively coated on copper wires (grade: 14AWG/3G) by dipping and then placed in an oven, dried at 60° C. for 120 minutes, 80° C. for 120 minutes, 100° C. for 120 minutes, and finally, molded at 120° C. for 360 minutes.

After completely hardening, the obtained fire-resistant wire was subjected to a UL 1581 Vertical Wire Flame Test VW-1, the results of which are shown in Table. 9. In all tests, the outer sheath layers of the organic/inorganic composites were ignited, and the flags (attached at the top of sample) were ignited and burned. The test was considered to be a failure. Further, flaming debris dropped from the sample ignited the cotton placed on the floor around the sample.

Accordingly, because the polyurethane does not have an —NCO functional group, there was no functional group to react with the —OH functional group of aluminum hydroxide powder. Therefore, in the comparative example 2, the outer sheath of the fire-resistant wire does not comprise the organic/inorganic composite as disclosed in the invention and exhibits inferior flame retardant property.

TABLE 9

| Thickness | NO. | 1st. | 2nd. | 3rd. | 4th. | 5th. | Burn Flag? yes/no | Ignite Cotton? yes/no | Rating Pass | Rating Fail |
|---|---|---|---|---|---|---|---|---|---|---|
| | | Afterburn after each 15 second flame application Record Flaming Duration in seconds | | | | | | | | |
| 0.52 ± 0.05 mm | 1 | None | 79 (fully burned) | | | | yes | yes | | X |
| | 2 | | 84 (fully burned) | | | | yes | yes | | X |
| | 3 | | 80 (fully burned) | | | | yes | no | | X |
| | | After each 15 second flame application Record Flaming Duration in seconds | | | | | | | | |
| 1.17 ± 0.05 mm | 1 | None | 114 (fully burned) | | | | yes | yes | | X |
| | 2 | | 96 (fully burned) | | | | yes | yes | | X |
| | 3 | | 82 (fully burned) | | | | yes | yes | | X |
| 1.88 ± 0.05 mm | 1 | None | 83 (fully burned) | | | | yes | no | | X |
| | 2 | | 88 (fully burned) | | | | yes | yes | | X |
| | 3 | | 97 (fully burned) | | | | yes | yes | | X |

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fire-resistant wire or cable, comprising:

a conductor wiring; and an organic/inorganic composite as an insulation layer or an outer sheath layer; comprising:

30-70% by weight of an organic component having a first reactive functional group of isocyanate, the organic component comprising polymer, copolymer, or oligomer; and 70-30% by weight of flame retardant inorganic particles having a second reactive functional group of hydroxyl;

wherein the flame retardant inorganic particles are chemically bonded to the organic component via a reaction between the first and second reactive functional groups, and wherein the flame retardant inorganic particles are metal hydroxide.

2. The fire-resistant wire or cable as claimed in claim 1, wherein the organic component comprises polyurethane, or polyolefin copolymer having isocyanate groups.

3. The fire-resistant wire or cable as claimed in claim 1, wherein the metal hydroxide comprises $Al(OH)_3$ or $Mg(OH)_2$.

4. The fire-resistant wire or cable as claimed in claim 1, wherein the organic/inorganic composite is coated on the conductor wiring by dipping or extrusion.

5. The fire-resistant wire or cable as claimed in claim 1, wherein the fire-resistant wire or cable has a sufficient flame retardant property to pass the UL 1581 Vertical Wire Flame Test VW-1.

* * * * *